United States Patent [19]

Bogoshian

[11] 4,280,443

[45] Jul. 28, 1981

[54] ROLL FUSER LOADING SYSTEM

[75] Inventor: Gregory V. Bogoshian, Rochester, N.Y.

[73] Assignee: Xerox Corporation, Stamford, Conn.

[21] Appl. No.: 100,165

[22] Filed: Dec. 4, 1979

[51] Int. Cl.[3] ..... G03G 13/20; B05C 11/00

[52] U.S. Cl. ..... 118/60; 118/260; 432/60

[58] Field of Search ..... 118/60, 101, 260, 116; 432/60; 430/98, 99; 219/216; 355/3 FU

[56] References Cited

U.S. PATENT DOCUMENTS

| | | | |
|---|---|---|---|
| 3,331,592 | 7/1967 | Cassano et al. | 432/60 |
| 3,449,548 | 6/1969 | Adamek et al. | 432/60 |
| 4,136,613 | 1/1979 | Namiki | 118/60 |

*Primary Examiner*—John P. McIntosh

[57] ABSTRACT

Roll fuser apparatus for fixing toner images on copy substrates. This apparatus is characterized by simplicity of design and serviceability. To this end, the fuser roll, pressure roll and a weighted wick are all supported for vertical movement such that raising the pressure roll which is below the fuser roll which, in turn, is below the wick causes engagement with the fuser roll and then engagement between the fuser roll and wick. Downward movement of the pressure roll will effect disengagement of the pressure roll from the fuser roll as well as automatic disengagement of the wick from the fuser roll.

6 Claims, 3 Drawing Figures

ROLL FUSER LOADING SYSTEM

BACKGROUND OF THE INVENTION

This invention relates generally to xerographic copying apparatus, and more particularly, it relates to the heat and pressure fixing of particulate thermoplastic material arranged in image configuration by direct contact with a heated fusing member having a release fluid applied thereto.

In the process of xerography, a light image of an original to be copied is typically recorded in the form of a latent electrostatic image upon a photosensitive member with subsequent rendering of the latent image visible by the application of particulate thermoplastic material, commonly referred to as toner. The visual toner image can be either fixed directly upon the photosensitive member or transferred from the member to another support, such as a sheet of plain paper, with subsequent affixing of the image thereto, one method of affixing comprising the application of heat and pressure.

In order to affix or fuse electroscopic toner material onto a support member by heat and pressure, it is necessary to elevate the temperature of the toner and simultaneously apply pressure sufficient to cause the constituents of the toner to become tacky and coalesce. This action causes the toner to flow to some extent into the fibers or pores of support members or otherwise upon the surfaces thereof. Thereafter, as the toner material cools, solidification of the toner material occurs causing the toner material to be bonded firmly to the support member. In both the xerographic as well as the electrographic recording arts, the use of thermal energy for fixing toner images onto a support member is old and well known.

One approach to heat and pressure fusing of electroscopic toner images onto a support has been to pass the support with the toner images thereon between a pair of pressure engaged roller members, at least one of which is internally heated. During operation of a fusing system of this type, the support member to which the toner images are electrostatically adhered is moved through the nip formed between the rolls with the toner image contacting the fuser roll thereby to effect heating of the toner images within the nip. By controlling the heat transferred to the toner, virtually no offset of the toner particles from the copy sheet to the fuser roll is experienced under normal conditions. This is because the heat applied to the surface of the roller is insufficient to raise the temperature of the surface of the roller above the "hot offset" temperature of the toner at which temperature the toner particles in the image areas of the toner liquefy and cause a splitting action in the molten toner resulting in "hot offset". Splitting occurs when the cohesive forces holding the viscous toner mass together is less than the adhesive forces between it and a contacting surface such as a fuser roll.

Occasionally, however, toner particles will be offset to the fuser roll by an insufficient application of heat to the surface thereof (i.e. "cold" offsetting); by imperfections in the properties of the surface of the roll; or by the toner particles insufficient adhering to the copy sheet by the electrostatic forces which normally hold them there. In such cases, toner particles may be transferred to the surface of the fuser roll with subsequent transfer to the backup roll during periods of time when no copy paper is in the nip.

Moreover, toner particles can be picked up by the fuser and/or backup roll during fusing of duplex copies or simply from the surroundings of the reproducing apparatus.

One arrangement for minimizing the foregoing problems, particularly that which is commonly referred to as "offsetting", has been to provide a fuser roll with an outer surface or covering of polytetrafluorethylene, known by the trade name, Teflon (DuPont trademark), to which a release agent such as silicone oil is applied, the thickness of the Teflon being on the order of several mils and the thickness of the oil being less than 1 micron. Silicone based oils, (polydimethylsiloxane), which possess a relatively low surface energy, have been found to be suitable for use in the heated fuser roll environment where Teflon constitutes the outer surface of the fuser roll. In practice, a thin layer of silicone oil is applied to the surface of the heated roll to form an interface between the roll surface and the toner images carried on the support material; Thus, a low surface energy layer is presented to the toner as it passes through the fuser nip and thereby prevents toner from offsetting to the fuser roll surface.

A fuser roll construction of the type described above is fabricated by applying in any suitable manner a solid layer of adhesive material to a rigid core or substrate, such as the solid Teflon outer surface or covering of the aforementioned arrangement.

In attempts to improve at least the perceived quality of the image fused or fixed by a heated roll fuser, such rolls have been provided with conformable surfaces comprising silicone rubber. As in the case of the Teflon coated fuser roll release fluids such as silicone based oils have been applied to the surface of the silicone rubber to both minimize offsetting and to facilitate stripping. See, for example, U.S. Pat. No. 3,964,431.

A common expedient for applying the slicone oil to the surface of the fuser roll is by means of a Nomex (DuPont trademark) wick, one end of which contacts the surface of the roll and the outer end of which is immersed in silicone oil contained in a sump.

Prior to the employment of silicone rubber fuser rolls it has been the practice to allow continuous contact of the wick with the fuser roll. However, it has been found that this practice, particularly, with respect to low copy volume machines causes severe puddling problems resulting in rubber swelling, excessive oil consumption and unacceptable fixing of the images.

BRIEF SUMMARY OF THE INVENTION

Briefly, the present invention relates to a roll fuser apparatus which is simple in construction and readily serviceable. To these ends the fuser roll and pressure roll are mounted such they can both move in a straight line when the pressure roll is cammed into an operating position. A wick for intermittently applying release agent to the fuser roll is supported above the fuser roll such that when the pressure roll moves the fuser roll the wick is contacted by the fuser roll. The wick has a weight support which provides for pressure engagement with the fuser roll due solely to this weight. The wick support is arranged for vertical displacement by dowel and pin means which allow the wick assembly to be simply lifted off its support for replacement. Lowering of the pressure roll for inoperative periods causes its disengagement from the fuser roll as well as automatic wick disengagement by virture of such roll movement.

DETAILED DESCRIPTION OF THE PREFERRED EMBODIMENT OF THE INVENTION

Figure 1:
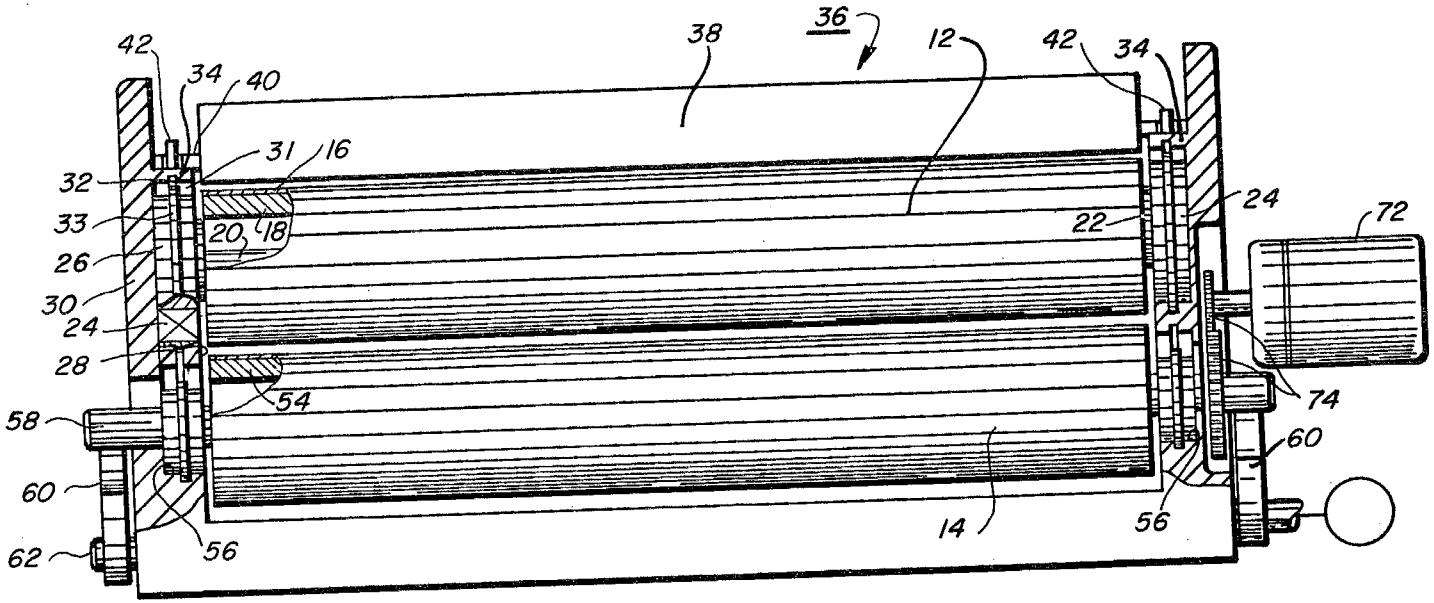
FIG. 1 is a front elevational view of a fuser apparatus representing the invention.
Figure 3:
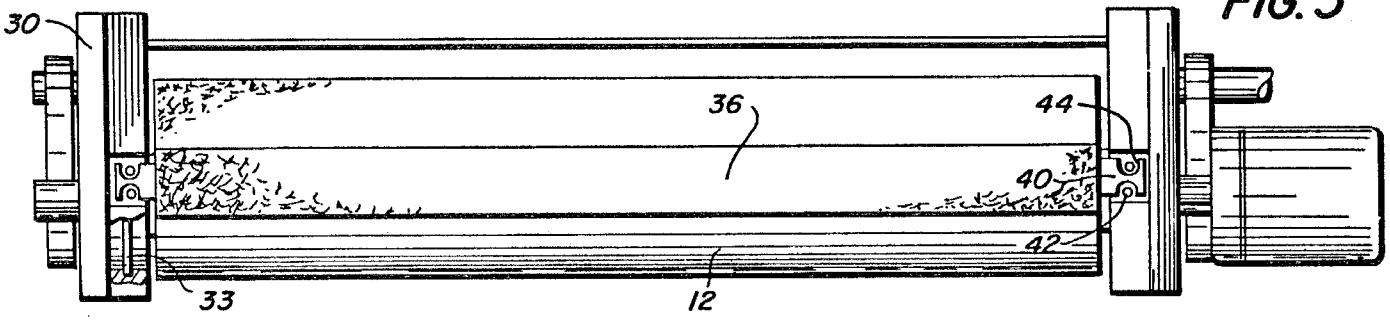
FIG. 3 is a top view of a wick support.

As illustrated in FIG. 1 the present invention comprises a roll fuser apparatus 10 for fusing thermoplastic images to copy substrates such as plain paper. This apparatus comprises a fuser roll member 12 and a pressure roll member 14. The roll members are preferably 15 inches in length and the fuser roll member comprises a silicone rubber coating 16 which has a thickness on the order of 0.030 inches and which is adhered to a metal core 18 fabricated from a material such as aluminum. Silicone rubber is employed because of its low affinity for thermoplastic materials. Other materials may be used as the coating 16, for example, Viton (DuPont trademark). The core 18 has a conventional heating element 20 supported internally thereof for elevating the surface temperature of the fuser member to a temperature adapted to soften the thermoplastic images. The exact temperature will vary depending upon such factors as types of thermoplastic material employed, etc. The core 18 is provided with a pair of end closures 22 through which the heating element extends. Bearing structures 24 are fitted on the end closures and support the fuser roll member 12 for rotation. The bearings are mounted in bearing blocks 26 which are supported by a pair of brackets 28 attached to side frame members 30. The fuser roll member, as disclosed, is adapted to be vertically displaced by the provision of vertical grooves 32 provided in frame member 31 which receive tongue portions 33 of the bearing blocks 26 and permit them to move in the vertical direction. It will be appreciated that while the roll members 12 and 14 have been disclosed in one orientation, (i.e. vertically oriented) the particular orientation is not critical to the inventive concept.

Figure 2:
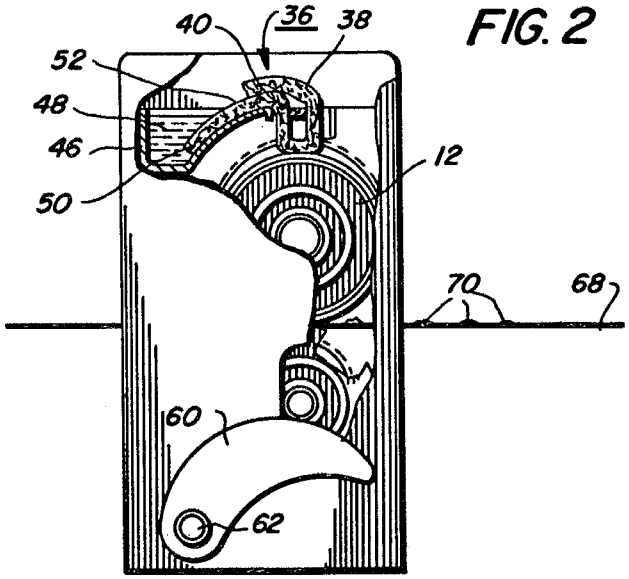
FIG. 2 is a side elevational view of the fuser apparatus of FIG. 1.

Upward movement of the fuser roll member 12 is limited by positive stops 34 in the form of brackets similar to the brackets 28. The brackets 34 serve to support a wick structure 36 shown in FIGS. 1 and 2. The structure 36 comprises a wick 38 preferably fabricated from needled Nomex (DuPont trademark) having a thickness of 3/16 inch and a density of 0.08 grams cc dry. The wick is wrapped around a wick holder or support 40. Attachment is accomplished by stitching, stapling, or by any suitable means for securing one end of the wick to an intermediate portion part of the wick as shown. The holder or support is sufficiently heavy to effect pressure engagement of the wick and fuser roll member by means of gravity. To this end, the wick structure 36 is freely supported by the brackets 34 and is guided by dowel pins 42 cooperating with vertical recesses 44 provided in support 40.

The wick 38 is pre-soaked with 60,000 cs. silicone oil to a concentration of 0.4 grams/cc. A sump 46 is provided for holding a supply of silicone oil 48. A tail portion 50 of the wick 38 is captivated in a slot 52 provided in the sump 46. Accordingly, silicone oil is conveyed from the sump to the surface of the fuser roll member 12 via the wick 38.

The pressure roll member 14 comprises a rigid metallic core 54 preferably fabricated from aluminum, although other materials are acceptable. The core 54 is provided with a relatively thin (i. e. 1–2 mils) of a non-stick or abhesive material such as Teflon (Du Pont trademark). The pressure roll member 14 is adapted for vertical displacement in the same manner as the fuser roll member 14, that is by the provision of cooperating tongues and grooves in its bearing blocks. The pressure roll member is supported, by surfaces 56 which are provided in the frame 30. The pressure roll is adapted to be raised off the support surface 56 through the engagement 68 of cams 60 with the shaft 62 of the pressure roll. The cams 60 are carried by a cam shaft 62 which is rotated by motor drive structure 64.

During the operating cycle of the fuser apparatus 10 the roll members are pressure engaged to form a nip (not shown) through which copy substrates 68 pass with toner (i. e. suitable thermoplastic resin material) images 70 thereon contacting the heated fuser roll member 12. The nip is formed by virtue of the harder roll member 14 deforming the softer roll 12 which is referred to as a nip forming fuser roll system. However, a nip forming pressure roll may also be utilized in this invention. In order to effect engagement of the roll members 12 and 14, the cam members 60 are actuated through rotation of shaft 62 which causes upward travel of the pressure roll 14 so that it contacts the fuser roll member 12. Continued camming action causes simultaneous upward movement of the fuser roll and pressure roll members causing the surface of the fuser roll member to lift the wick structure off its support brackets 34 thus loading the wick to the fuser roll member 14 by virtue of the weight of the wick structure. Camming action continues until the bearing blocks 26 engage against the fuser roll member stops or brackets 34. Further upward movement of the pressure roll causes formation of the nips and continues until the pressure roll bearing blocks engage bracket 28.

Reverse rotation of the shaft 62 will effect disengagement of the roll members 12 and 14 as well as automatic disengagement of the fuser roll member and the wick 38. This action takes place during standby periods when no copies are being made. It is more important to keep the wick from contacting the fuser roll during motionless (i. e. rolls are not rotating) standby particularly in a low copy volume machine which spends the greatest portion of its life in standby. Some such machines spend as much as 97% of their life in standby. The result of continuous contacting of the fuser roll member by the wick is puddling which causes unexceptionally high consumption rates and increased operational and service costs due to more frequent replacement of the fuser wick and oil. Also, the fusing fix levels in the puddles areas would be unacceptable. A motor 72 and gear train 74 is provided for imparting rotational movement to the pressure roll 14 and the roll member 12 through its frictional engagement with the pressure roll 14. The motor is programmed to rotate the roll members 12 and 14 at least on revolution after the lost copy is fused and before separation of the wick and fuser roll member takes place in order to insure that there is a coating of release agent on the fuser roll member after copying.

It should now be apparent that a simply constructed, easily serviced fuser apparatus has been provided wherein a wick for applying release agent material to the fuser roll is automatically disengaged when the fuser roll and pressure roll are disengaged.

What is claimed is:

1. Roll fuser apparatus comprising:

first and second roll members;

wick means for applying release agent material to one of said roll members through contact therewith;

means for supporting said wick means out of contact with said one of said roll members;

means for supporting said roll members in a spaced apart relationship and in a manner that they are free to move;

means for effecting pressure engagement of said roll members and simultaneous displacement thereof in one direction whereby said one of said roll members is moved into contact with said wick means and displacement of said roll members in the opposite direction whereby said one of said roll members is moved out of contact with said wick means; and said roll members are disengaged.

2. Apparatus according to claim 1 wherein said wick means comprises a relatively heavy support member to which wick material is attached, said relatively heavy support member being adapted under the influence of gravity of effect pressure engagement of said wick material with said one of said roll members and wherein said engagement effecting means is adapted to cause said one of said roll members to lift said wick means off said wick supporting means.

3. Apparatus according to claim 2 including means for elevating the temperature of said one of said roll members.

4. Apparatus according to claim 3 wherein said one of said roll members has an outer coating of silicone rubber.

5. Apparatus according to claim 1 for effecting rotation of said one of said roll members during contact of said one of said roll members while it contacts said wick means and until it is moved out of contact with said wick whereby said one of said roll members is left with a coating of release agent thereon after termination of operation of said fuser apparatus.

6. Roll fuser apparatus comprising:

a first roll member;

a second roll member;

a wick for applying silicone oil to at least one of said roll members;

means for supporting said roll members in pressure engagement with each other and one of said roll members in rubbing contact with said wick during a fusing mode of operation;

means for supporting said roll members out of contact with each other and said one of said roll members out of contact with said wick during a standby mode of operation;

means for effecting movement of the other of said roll members in the direction of said one of said roll members whereby said rolls contact, said movement effecting means further causing engagement of said wick and said one of said roll members through simultaneous movement of said roll members.

* * * * *